United States Patent [19]

Litchfield et al.

[11] 4,298,234

[45] Nov. 3, 1981

[54] DRAWERS AND DRAWER COMPONENTS

[75] Inventors: Leon G. Litchfield; Terence Hardy, both of Belper, England

[73] Assignee: L.B. (Plastics) Limited, Belper, England

[21] Appl. No.: 27,765

[22] Filed: Apr. 6, 1979

Related U.S. Application Data

[62] Division of Ser. No. 816,039, Jul. 15, 1977, Pat. No. 4,162,114.

[30] Foreign Application Priority Data

Apr. 26, 1977 [GB] United Kingdom ..... 17290/77

[51] Int. Cl.[3] ..... F16C 29/00; F16C 29/10

[52] U.S. Cl. ..... 308/3.6; 308/3.8; 312/330 R

[58] Field of Search ..... 308/3.6, 3.8, 6 R; 312/330 R, 346, 350, 349

[56] References Cited

U.S. PATENT DOCUMENTS

| | | | |
|---|---|---|---|
| 3,528,718 | 9/1970 | Johnson et al. | 312/330 R |
| 3,664,716 | 5/1972 | Johnson | 308/3.8 |
| 4,037,885 | 7/1977 | Röck et al. | 308/3.8 |
| 4,065,196 | 12/1977 | Stein | 308/3.8 |
| 4,162,114 | 7/1979 | Litchfield et al. | 308/3.8 |
| 4,196,943 | 4/1980 | Röck et al. | 308/3.8 |

*Primary Examiner*—Lenard A. Footland
*Attorney, Agent, or Firm*—C. O. Marshall, Jr.

[57] ABSTRACT

A drawer runner comprising an elongated member of angle section having a mounting flange by means of which the runner may be mounted at a suitable location in a drawer supporting structure and a drawer-engaging flange projecting at right angles to the mounting flange and adapted to extend into a track formed in the drawer side, the drawer-engaging flange being provided with or being adapted to engage with means for slidably supporting the drawer in the supporting structure.

6 Claims, 5 Drawing Figures

DRAWERS AND DRAWER COMPONENTS

The invention relates to drawers and to parts and components thereof, especially drawer runners and is a divisional from application Ser. No. 816,039 filed July 15, 1977, U.S. Pat. No. 4,162,114.

Drawers are conventionally mounted either on fixed runners or on roller runners. The former provide a simple means of mounting drawers in cabinets or the like but suffer from the disadvantage that relatively high friction forces are present between the drawer and the runners, and drawers mounted in this way are not generally suitable for carrying heavy loads. Roller runner assemblies, though more complicated, eliminate or reduce friction between the drawer and its runners, thereby enabling greater loads to be carried.

A disadvantage of roller runner assemblies is that separate guide or runner members require to be mounted both in the supporting cabinet and on the drawer itself in order to accommodate the roller assembly between them and the extent to which such runner assemblies project from the opposite sides of the drawer reduces the overall width of drawer which can be accommodated in a cabinet having an opening of a predetermined size. Additionally the working parts of the roller assembly itself are liable to become fouled by dirt and other foreign matter which can cause malfunctioning.

It is an object of the present invention to obviate or mitigate these disadvantages.

According to the invention there is provided a drawer runner comprising an elongated member of angle section having a mounting flange by means of which the runner may be mounted at a suitable location in a drawer cabinet or like supporting structure and a drawer-engaging flange projecting at right angles to the mounting flange and adapted to extend into a track or channel formed in a drawer side, the drawer-engaging flange being provided with or being adapted to engage with means for slidably supporting the drawer in the cabinet or like structure.

The invention also provides a drawer assembly comprising a drawer having integral tracks formed on the sides thereof, a pair of drawer runners of angle section having drawer-engaging flanges adapted for engagement with said tracks and dimensioned so as to leave a clearance above and below same when located in the tracks, a front guide and bearing member interposed between each runner and the associated track at the forward end of the runner and a rear guide and bearing member incorporated in each rear corner of the drawer to guide and support the rear end of the drawer on the respective runner.

In addition the invention provides an article of furniture comprising a cabinet or housing and a drawer supported in the cabinet or housing by means of runners of angle section having portions thereof extending into and retained against lateral withdrawal from tracks in the drawer sides. Preferably front guide and bearing members are mounted at the forward ends of said portions of the runners to slidably support and guide the drawer thereon. Alternatively said portions of the runners may be provided with projecting bearing surfaces or with bearing members on which the drawer is slidably supported.

Embodiments of the invention will now be described, by way of example only, with reference to the accompanying drawings in which.

Figure 1:
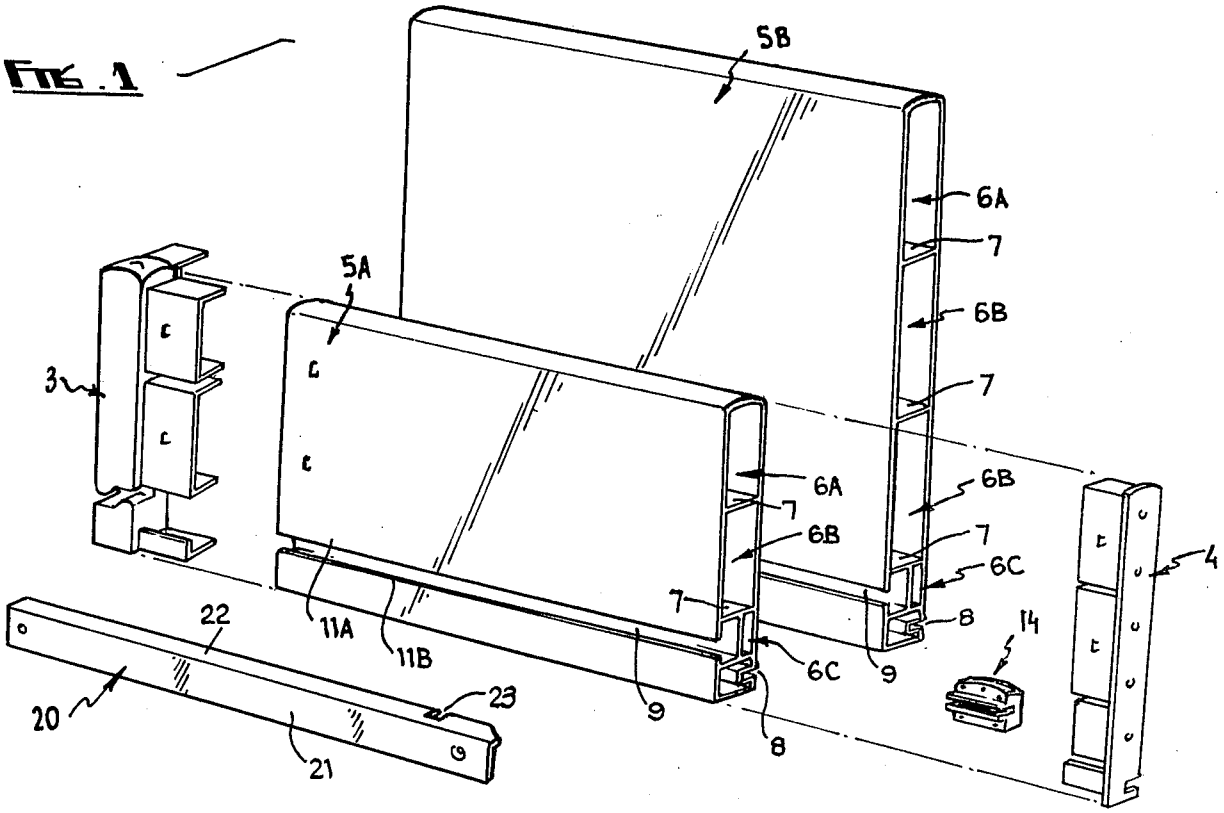
FIG. 1 is an exploded perspective view showing part of one form of drawer and runner construction incorporating features of the invention.

The drawer constructions shown in the drawings are of so called "knock-down" construction, the sides and back comprising identical extruded hollow panels interconnected at right angles to one another by corner pieces. The forward ends of the side panels are connected to the drawer front by means of end connectors, and inwardly directed slots are provided adjacent the lower edges of the panels to receive the edges of a drawer bottom.

FIG. 1 shows two alternative sizes of side panel 5A and 5B, both of extruded plastics construction and of hollow section. The side and back panels are interconnected by corner pieces 3 and end connectors 4 serve to connect the drawer sides to a suitable facia panel.

The drawer panel 5A comprises upper, intermediate and lower hollow sections 6A, 6B and 6C separated by internal webs 7. The larger side panel 5B incorporates an additional intermediate section 6B but is otherwise of similar construction. An inwardly directed recess 8 is formed adjacent the lower longitudinal edge of the panel to accommodate an edge of a drawer bottom (not shown). The lower hollow section 6C of the panel incorporates a longitudinal channel 9 the entrance to which comprises a narrow slot 10 defined between upper and lower longitudinal lips 11A, 11B extending across the channel 9 towards one another so as to partially enclose same. The channel 9 constitutes an integral runner track designed to accommodate a guide and bearing member 14.

Figure 2:
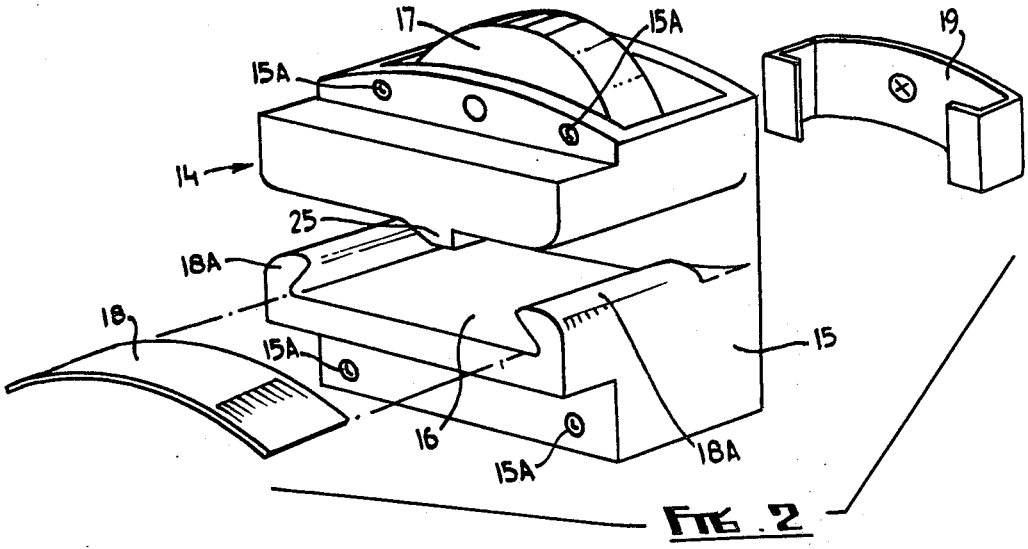
FIG. 2 is an enlarged perspective view of the guide and bearing member shown in FIG. 1.

The guide and bearing member is shown in greater detail in FIG. 2 and comprises a body portion or carriage 15 formed with a through track or slot 16 and surmounted by a rotatable roller 17. A curved leaf spring 18 is located in the bottom of the track 16 between inturned lips 18A, and a further curved leaf spring 19 engages with the portion of the body 15 defining the back or inner wall of the recess 16 so as to project therefrom in the opposite direction from the recess. Pips 15A project from the faces of the body portion which engage the lips 11A, 11B of the track 9 to reduce frictional contact. Similar pips (not shown) are provided on the underside of the body portion.

In use the guide and bearing member is located in the track 9 with the roller 17 uppermost and the recess or slot 16 in alignment with the narrow entrance 10 to the track 9. The member is retained in the track by the lips 11A, 11B and by the corner piece 3 and front connector 4 which are located in the ends of the drawer panel when the drawer is assembled.

It should be noted that the extents to which the lips 11A and 11B extend across the channel 9 differ slightly. This is designed to ensure that the guide and bearing member 14 cannot be inserted into the channel upside down.

The guide and bearing member is adapted for engagement with a fixed drawer runner 20 (FIG. 1) of angle form and L-shaped cross-section having a mounting flange 21 by means of which the runner may be mounted in a suitable position in a cabinet or like housing in which the drawer is to be slidably located, and a drawer-engaging flange 22 which projects at right angles from the securing flange and is adapted to extend into the channel 9 for locking engagement with the guide and bearing member 14. For this purpose a notch 23 is formed adjacent the forward end of the drawer-engaging flange 22 and is adapted to engage with the guide and bearing member to retain same in a fixed position on the runner 20. A downwardly directed projection 25 is formed on the upper surface of the slot 16 in the guide and bearing member and engages with the notch 23 in the runner 20, engagement being maintained by virtue of the spring 18 urging the guide and bearing member downwardly and thereby retaining the projection 25 in the notch.

The spring 19 serves to urge the guide and bearing member bodily away from the back or inner wall of the track 9 and accommodates for differences in tolerance of the drawer components introduced during manufacture by allowing the guide and bearing member to adopt different positions in the track 9 dependent on the extent to which the runner flange 22 extends into the track.

Figure 3:
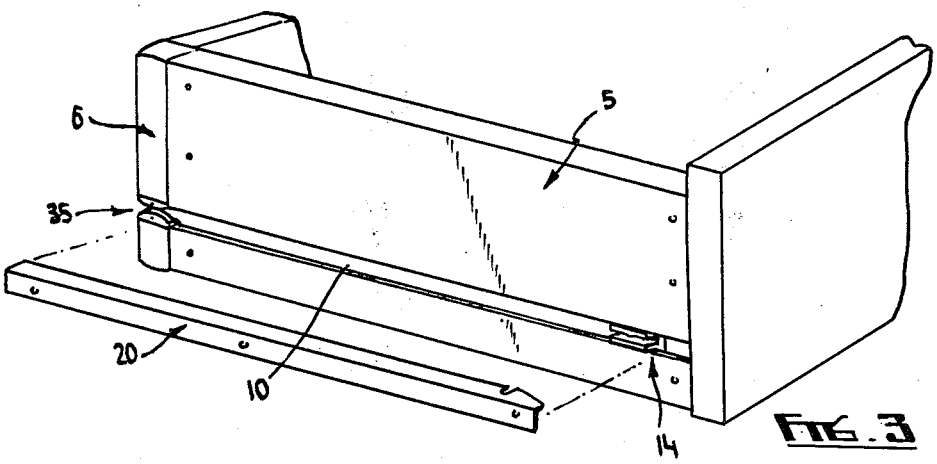
FIG. 3 is a fragmentary perspective view of a drawer and runner construction showing the drawer assembled.

FIG. 3 shows a slightly modified arrangement with the drawer assembled. A modified form of corner connector 35 is shown in FIG. 3 but in other respects the arrangement is the same as that shown in FIG. 1.

In use, the drawer is supplied to the customer in disassembled condition and is erected by inserting the corner pieces 3 or 35 in the open ends of the side and back panels thereby joining same together at right angles to one another. Thereafter the guide and bearing members 14 may be inserted in the tracks 9 in the side walls and the drawer bottom engaged in the slots 8. The front connectors 4 are then secured to the facia panel in suitable positions corresponding to the spacing of the drawer sides and the assembly comprising the facia panel and the front connectors is then engaged with the remainder of the drawer by pushing the front connectors into the hollow ends of the side wall panels. The guide and bearing members are then trapped within the tracks 9 at opposite sides of the drawer but are free to slide longitudinally thereof.

The drawer may then be inserted in the cabinet or the like in which it is to be housed and which is first of all provided with opposed runners 20. The drawer may be engaged with the runners by simply pushing it into the opening in the cabinet to its fully closed position in which the projections 25 on the guide and bearing members reach the notches 23 in the respective runners. The guide and bearing members then lock on to the associated runners and are retained in position, the drawer being free to slide along the runners between the limits defined by engagement of the guide and bearing members with the corner pieces and front mouldings which are disposed at opposite ends of the tracks 9. If it is desired to release the drawer from the cabinet the springs 18 are depressed by lifting the front of the drawer, thereby allowing the guide and bearing members to be disengaged from the slots 23 whereupon the drawer can be drawn completely out of the cabinet.

It will be appreciated that the arrangement described provides a drawer construction at least partially mounted on roller runner assemblies which is of simple and compact construction. By virtue of the provision of the channels or tracks within the dimensions of the side panels themselves, together with the angle form of the runners, the overall width of the drawer which can be accommodated in an opening of a given size is increased compared with similar drawers utilising conventional roller runner assemblies. The moving parts are also wholly enclosed within the drawer panels themselves and thereby protected from damage.

Figure 4:
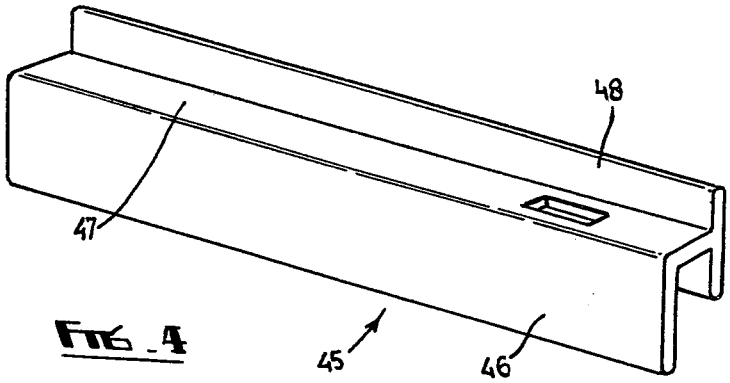
FIG. 4 is a perspective view of a modified drawer runner.

FIG. 4 shows a modification enabling the drawer to be used with a fixed runner system. For this purpose the runner 20 shown in FIG. 1 is replaced by an alternative runner 45 shown in FIG. 4 having a vertical or mounting flange 46 enabling the runner to be attached to a drawer cabinet or the like in a suitable position, and a horizontal or drawer-engaging flange 47 which, in use, extends into the track 9 through the narrow entrance slot 10. The runner also incorporates a supporting and guiding flange 48 extending at right angles to the flange 47 and providing an upwardly directed bearing surface on which the drawer runs. In use the flange 48 is trapped within the track 9 in the drawer side thereby retaining the drawer against lateral movement and providing a bearing surface on which the drawer may run.

A modified form of corner connector is utilised in association with the runner 45. This connector is generally similar to that shown at 3 in FIG. 1 but incorporates a generally T-shaped recess in alignment with the channel 9 to accommodate the flange 48 as the drawer slides along the runner. In other respects the corner piece is constructed and functions in the same manner as that described with reference to FIG. 1.

Figure 5:
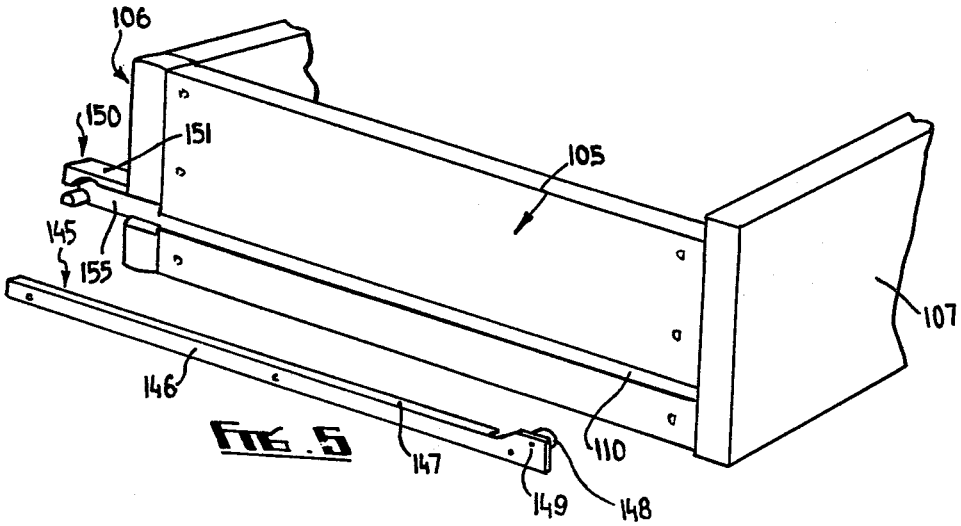
FIG. 5 is a fragmentary perspective view of a modified drawer and runner construction.

FIG. 5 shows a modification of the arrangement shown in FIG. 1 and wherever possible similar parts are designated by similar reference numbers increased by 100. Referring to FIG. 5, a side panel is shown at 105, a corner piece at 106 and a facia or front panel at 107. The drawer panel 105 is similar to the panel 5A shown in FIG. 1 and comprises upper, intermediate and lower hollow sections separated by internal webs. An inwardly directed recess is formed in the lower hollow section adjacent the lower longitudinal edge of the panel to accommodate an edge of a drawer bottom (not shown). The lower hollow section of the panel also incorporates a longitudinal channel 109, the entrance to which is narrower than the channel itself and comprises a slot defined between upper and lower longitudinal lips extending across the channel 109 towards one another so as to partially close same. The channel 109 constitutes an integral runner track.

The drawer is used in association with a runner 145 which has a vertical or mounting flange 146 enabling it to be attached to a drawer cabinet or the like in a suitable position, and a horizontal or drawer-engaging flange 147 which in use extends into the track 109 through the narrow entrance slot. At its forward end the vertical flange 146 is extended and carries a roller 148 rotatable about a horizontal pin 149. An insert 150 is used in association with the runner 145 and has a body portion 151 which projects to the rear of the drawer leaving a downwardly directed opening 155 forming an entrance to the channel 109. In this way the drawer may be mounted on the runners by engaging the rollers 148 with the openings 155 and pushing the drawer into the cabinet so that the rollers travel along the channels 109 at opposite sides of the drawer.

It will be appreciated that the drawer assembly may be utilised in association with any of the runner arrangements described without requiring any modification of the drawer itself other than the substitution of modified corner connectors and the use of the alternative runners. The same wall panels and front connectors are used and the drawers themselves are completely interchangeable as between one system and the other.

Various modifications may be made without departing from the invention. For example the construction of the front guide and bearing member may be altered and it could incorporate a fixed bearing surface of curved or other form instead of rollers. If desired a plurality of such guide and bearing members could be provided at spaced intervals along the associated runner; in this event it may be possible to dispense with the rear guide and bearing members. The drawer panels may also be of different construction provided they incorporate integral tracks for engagement with the drawer runners. The track is preferably contained within the dimensions of the wall panel itself but could in some instances be fitted to the outer surface thereof. Moreover though particularly beneficial when used in association with hollow extruded plastics drawer constructions in knock-down form, the invention is also applicable to other forms of drawer.

We claim:

1. In an article of furniture comprising a cabinet or housing, a drawer assembly comprising a pair of drawer runners of L-shaped cross-section mounted in said cabinet or housing, and a drawer slidably supported on said drawer runners, the drawer having side walls provided with longitudinal tracks formed integrally therewith and having relatively narrow entrances thereto defined by upper and lower longitudinally extending lips projecting across the entrances to said tracks and being flush with the outer surfaces of said side walls, and the runners having horizontal drawer-engaging flanges extending into said tracks through said entrances and carrying front drawer guide and bearing members at their forward ends for supporting the drawer in sliding relationship thereon, the guide and bearing members being confined within said tracks by virtue of the narrow entrances thereto.

2. A drawer assembly according to claim 1 including a rear guide and bearing member incorporated in each rear corner of the drawer to guide and support the rear end of the drawer on the respective runner.

3. A drawer assembly according to claim 2 wherein said rear guide and bearing members are removable and replaceable by selected ones of a plurality of alternatively useable guide and bearing members adapted to slidingly support and guide the rear end of the drawer on respective ones of a plurality of alternatively useable interchangeable drawer runners of L-shaped cross-section.

4. A drawer assembly according to claim 1 or 2 wherein at least one roller is non-detachably but rotatably mounted at the forward end of the runner for engagement in said track to form said front guide and bearing member, means being provided to permit entry of the roller carried by the runner into the track from the rear end thereof.

5. A drawer assembly according to claim 1 wherein each of said front guide and bearing members comprises a body member adapted for sliding engagement in the associated track, bearing means mounted on said body member so as to project from the upper surface thereof, and locking means incorporated in said body member for locking engagement with the associated runner.

6. A drawer assembly according to claim 5 wherein said locking means is operable to lock on to the drawer runner automatically on engagement between the runner and the guide and bearing member.

* * * * *